United States Patent [19]

Gamroth

[11] Patent Number: 4,493,270

[45] Date of Patent: Jan. 15, 1985

[54] HEATING UNIT

[76] Inventor: Arthur P. Gamroth, 1055 S. Barker Rd., Waukesha, Wis. 53186

[21] Appl. No.: 550,500

[22] Filed: Nov. 10, 1983

[51] Int. Cl.[3] ..... F23N 5/18

[52] U.S. Cl. ..... 110/188; 110/110; 110/186; 110/234; 110/300; 110/235

[58] Field of Search ..... 110/186, 234, 300, 299, 110/298, 102, 110, 314, 235, 315, 188; 122/136 R, 15

[56] References Cited

U.S. PATENT DOCUMENTS

| | | | |
|---|---|---|---|
| 178,372 | 6/1876 | Kidder . | |
| 537,054 | 4/1895 | Lyons . | |
| 1,565,359 | 12/1925 | Grant | 110/302 |
| 1,607,312 | 11/1926 | Schierenbeck | 110/302 |
| 1,607,691 | 11/1926 | Russell | 110/302 |
| 1,648,043 | 11/1927 | Dahlquist . | |
| 1,752,684 | 4/1930 | Mead . | |
| 1,816,110 | 7/1931 | Cannon . | |
| 1,960,072 | 5/1934 | Turner | 110/44 |
| 2,102,989 | 12/1937 | Bose | 47/2 |
| 2,549,252 | 4/1951 | Skelly | 110/47 |
| 3,022,753 | 2/1962 | Montgomery | 110/7 |
| 3,838,813 | 10/1974 | Brosenius | 237/13 |
| 4,123,979 | 11/1978 | Tesch | 110/212 |
| 4,201,186 | 5/1980 | Paquin | 126/83 |
| 4,307,702 | 12/1981 | Kolze et al. | 110/300 X |
| 4,362,269 | 12/1982 | Rastogi et al. | 110/234 X |
| 4,421,064 | 12/1983 | Lehtinen | 122/15 |

FOREIGN PATENT DOCUMENTS 3011780 10/1981 Fed. Rep. of Germany ..... 122/15

OTHER PUBLICATIONS

Paper No. 81,3590 "Downdraft-Channel Corncob-Fueled Gasifier-Furnace for Drying Corn" by C. B. Richey, et al., presented at the 1981 Winter Meeting of the American Society of Agricultural Engineers, Chicago, IL, Dec. 15-18, 1981.

*Primary Examiner*—Edward G. Favors

*Attorney, Agent, or Firm*—Barry E. Sammons

[57] ABSTRACT

An improved heating unit comprises a combustion chamber which includes a fuel-supporting perforated burning platform located a distance from the bottom of the combustion chamber. A perforated air plenum is disposed within the combustion chamber a short distance from the combustion chamber top wall to overly a portion of the burning platform. A blower forces air upwardly through the perforations in the burning platform to facilitate waste material combustion and the blower also forces air downwardly through the plenum perforations against the burning platform to further oxygenate the flames and thereby achieve nearly complete combustion. The pressure of incoming air into the combustion chamber forces the exhaust gases through the air passageway above the plenum and out through an exhaust pipe. A heat exchanger, taking the form of a water jacket, surrounds the combustion chamber to cool the combustion chamber and to recover the heat radiated upon combustion of the waste combustible material.

18 Claims, 6 Drawing Figures

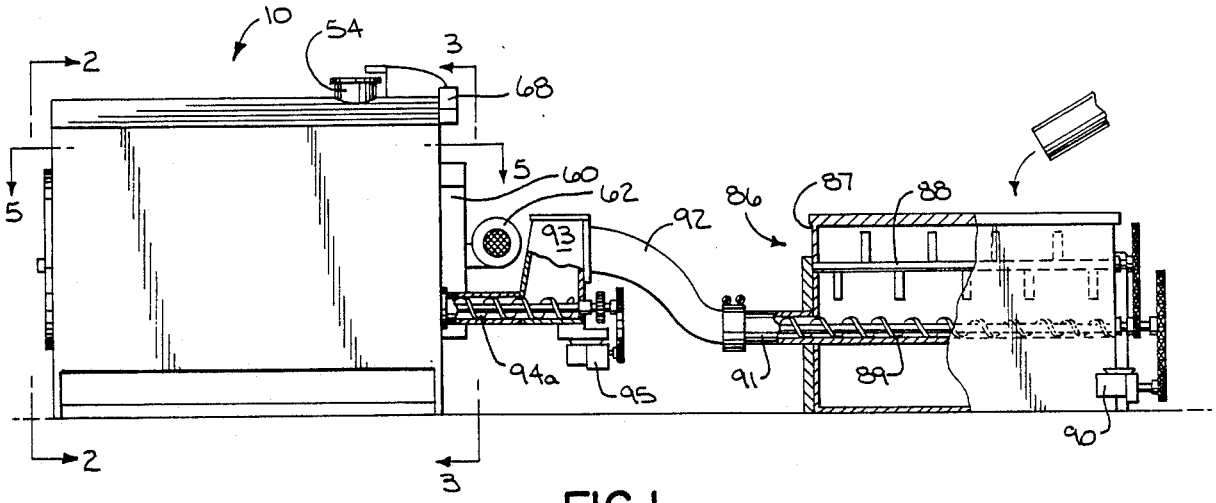
FIG.1
FIG.4
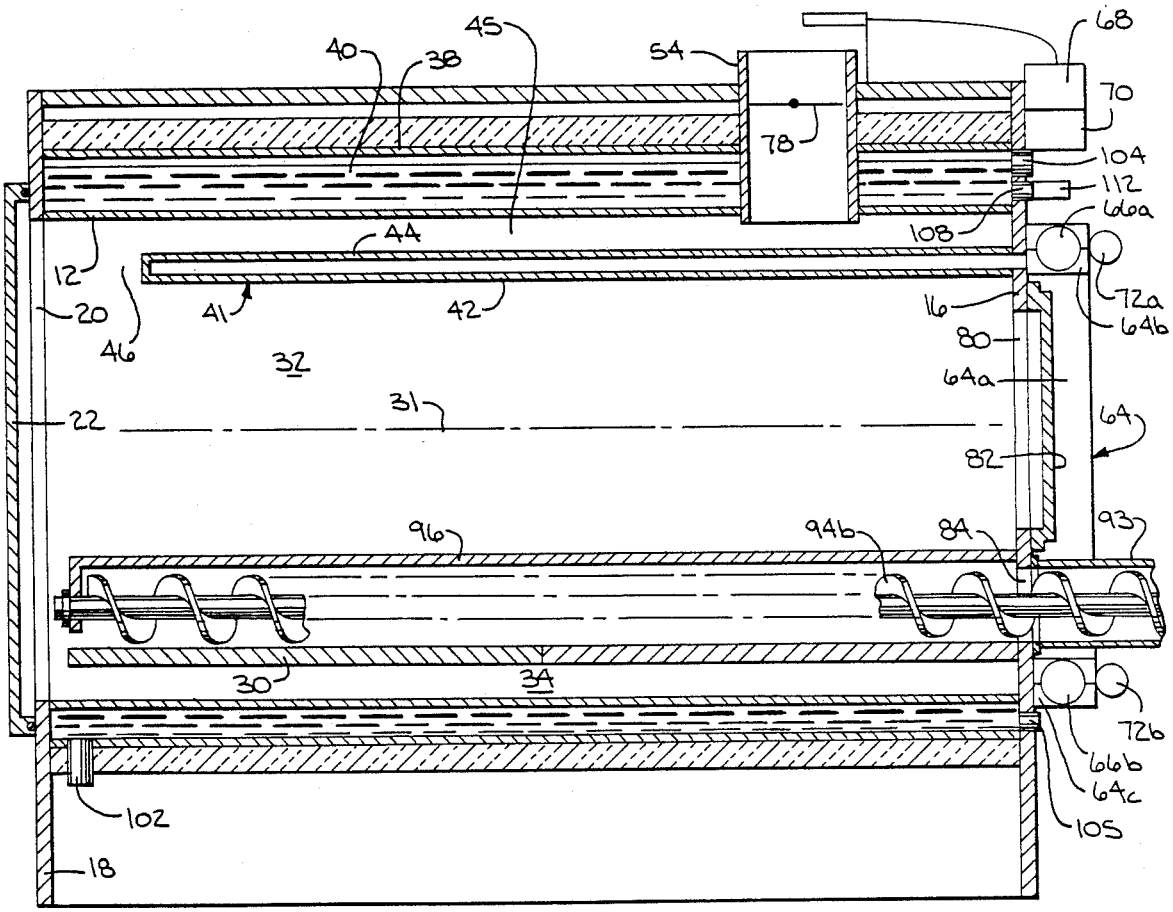

HEATING UNIT

BACKGROUND OF THE INVENTION

This invention relates generally to an improved heating unit, and more particularly, to an improved heating unit which achieves maximum heat recovery from combustible waste materials by achieving nearly complete fuel combustion.

The disposal of combustible waste materials, such as paper, sawdust, wood pallets and motor vehicle tires, by commercial and industrial establishments is usually accomplished by arranging for a refuse collection hauler to remove and transport such waste materials to a landfill dump site. However, the cost of such waste removal by refuse collection haulers is becoming increasingly expensive due in part to rising fuel and labor costs. Also, the availability of suitable landfill dump sites is becoming scarce due to more stringent environmental regulations. Rather than incur the expense of having combustible waste materials hauled to a suitable landfill dump site, most commercial and industrial establishments would prefer to burn such combustible waste materials on site and recover the usable heat. Unfortunately, most present day incinerators are at best only suitable to burn readily combustible waste materials such as paper and dried wood.

Just as many commercial and industrial establishments would prefer to burn combustible waste materials on site and recover the usable heat, thereby reducing fuel costs, many farmers would also prefer to burn combustible bio-mass waste products such as corncobs, walnut husks and the like, and recover the usable heat. Not only would burning of such bio-mass products eliminate the difficulties associated with their disposal, but also the burning of such waste bio-mass products and recovery of the usable heat would reduce the cost of fossil fuel used in conventional crop dryers. In the past, attempts to develop a suitable heating unit for burning bio-mass products such as corncobs to enable recovery of the heat for drying crops has not proven commercially feasible. Thus, farmers have had to rely on conventional, fossil fuel fired dryers for drying crops.

By my invention I advantageously provide a novel heating device which efficiently recovers usable heat from combustible waste materials by achieving almost complete fuel combustion, thereby reducing particulate emissions.

BRIEF SUMMARY OF THE INVENTION

Briefly, in accordance with the preferred embodiment of the invention there is provided an improved heating device for efficiently recovering usable heat from combustible materials by achieving nearly complete fuel combustion. The improved heating device of my present invention includes a combustion chamber having a perforated, fuel supporting burning platform spaced apart from the bottom of the combustion chamber, to create an air passageway between the burning platform and the combustion chamber. A perforated plenum is spaced from the top of the combustion chamber to overlie a portion of the burning platform, thereby creating an air passageway between the plenum and the top of the combustion chamber. A blower forces air through the air passageway between the burning platform and the bottom of the combustion chamber, and forces air through the plenum, to fully oxygenate the fuel on the burning platform to achieve nearly complete fuel combustion. An exhaust port is disposed through the combustion chamber in communication with the air passageway between the plenum and the top of the combustion chamber for exhausting gaseous combustion by-products forced into the air passageway by the pressure of the air forced by the blower. A heat exchanger, surrounds the combustion chamber to keep the combustion chamber from overheating, and to recover the usable heat radiated by combustion of the waste combustible materials. Adjustable air dampers may be provided to regulate air flow up through the burning platform and air flow into the plenum to achieve optimum fuel combustion without significant loss of heat through the exhaust port.

Small pellet-sized combustible materials such as sawdust wood chips, corncobs or the like may be automatically fed into the combustion chamber by a novel fuel feeding mechanism comprised of a storage bin having an auger. The auger feeds the pellet-sized material via a connecting elbow from the storage bin into the fuel feed hopper in communication with the combustion chamber. The fuel feed hopper carries a pair of opposing-pitch counter-rotating augers located above the base of the elbow for feeding the pellet-sized material into the combustion chamber to evenly throw the material onto the burning platform. Material accumulates in the elbow below the opposing-pitch counterrotating augers in the fuel feed hopper and serves to block the escape of pressurized air from the combustion chamber. Control of the storage bin auger and the pair of fuel feed hopper augers may be accomplished manually, or in response to the drop in the temperature of the heat exchange fluid thereby effecting automatic fuel feeding in response to heating demand.

It is an object of the present invention to provide an improved heating unit for achieving nearly complete combustion of waste combustible materials. Upward air flow is provided through the burning platform against waste combustible materials to achieve primary combustion and downward air flow is provided against the burning platform to further oxygenate the flames and force the flames against the surface of the burning waste combustible material to achieve nearly complete combustion.

It is yet another object of the present invention to provide a heating unit which achieves greater efficiency. Nearly complete combustion of the waste combustible materials, including hard to burn materials, such as rubber tires and green wood is achieved by the upward air flow through the fuel supporting burning platform and the downward air flow against the waste combustible material. The nearly complete fuel combustion maximizes the heat radiated to the heat exchanger.

It is yet a further object of the present invention to provide an improved fuel feeding mechanism for a heating unit for achieving even fuel feeding while preventing the escape of pressurized air. The opposing-pitch, counter-rotating augers in the feed hopper evenly throw fuel onto the burning platform. Fuel accumulating in the elbow below the primary augers in the feed hopper tends to block the escape of pressurized air to assure maximum combustion efficiency.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

FIG. 1 is a side view of the improved heating unit of the present invention;

FIG. 4 is a cross-sectional view of the heating unit of FIG. 1 taken along lines 4—4 of FIG. 3;

DETAILED DESCRIPTION OF THE PREFERRED EMBODIMENT

Figure 3:
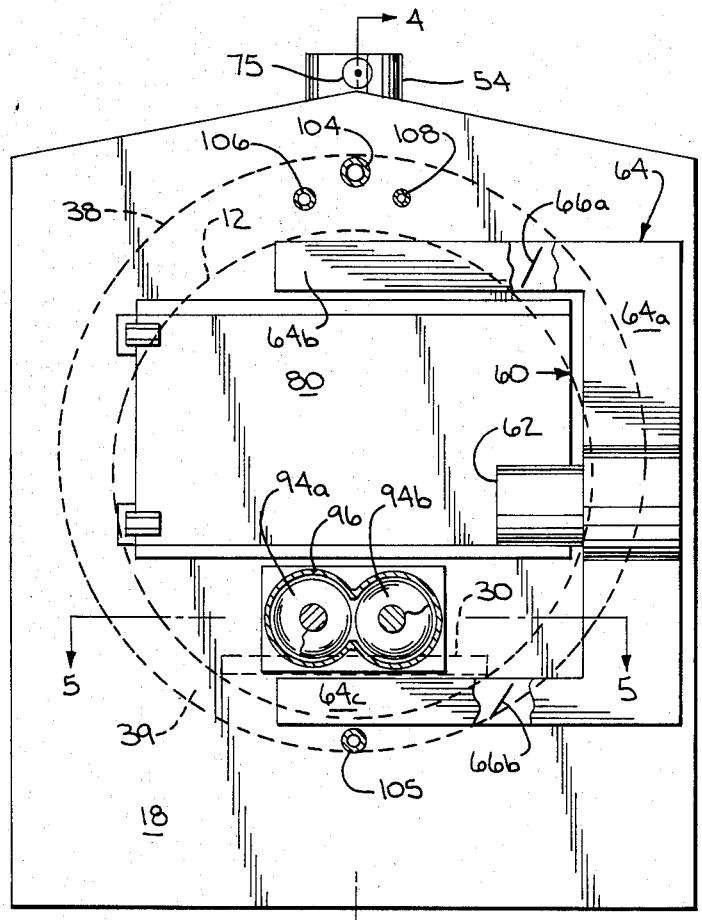
FIG. 3 is a rear-end view of the heating unit of FIG. 1 taken along lines 3—3 thereof.
Figure 2:
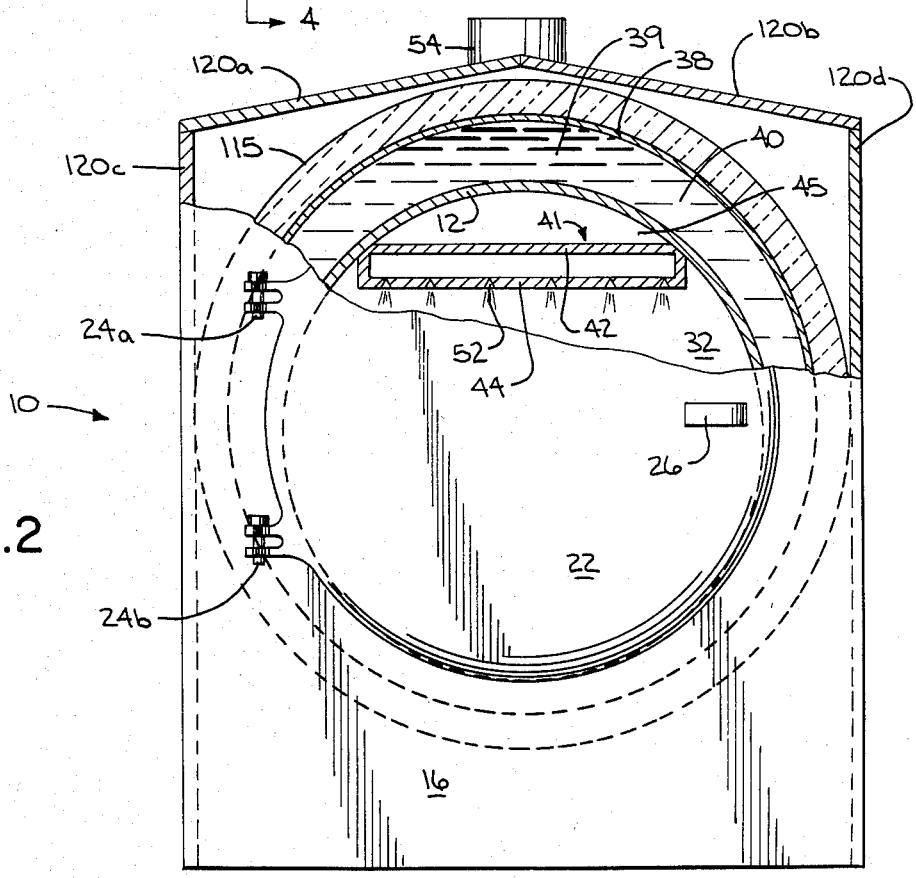
FIG. 2 is a front-end view of the heating unit of FIG. 1 taken along line 2—2 thereof.

FIGS. 1, 2 and 3 illustrate the side, front and rear views, respectively, of an improved heating unit 10 which advantageously achieves nearly complete combustion of waste materials such as wood and paper and even difficult-to-burn combustible materials, such as green wood, automobile tires and bio-mass products, thereby enabling efficient recovery of usable heat. Turning to FIG. 4 which is a cross-sectional view taken along lines 4—4 of FIG. 3, the improved heating unit 10 includes a combustion chamber 12 in which the combustible waste material is nearly completely burned by oxygenating the waste combustible materials from beneath and by entraining the upwardly rising flames with a secondary air supply to achieve additional fuel oxygenation. Typically, the combustion chamber 12 takes the form of an open-ended rolled steel cylinder, whose rightward end is sealed by way of a first steel end wall plate 16 welded to the cylinder 12. The leftward end of the cylinder 12 is closed by way of a second end wall plate 18, welded to the cylinder 12. Both of the end wall plates 16 and 18 extend below the base line of the cylinder as illustrated in FIG. 4 so as to support the cylinder upwardly from the ground level. Each of the end wall plates 16 and 18 are typically pentagon-shaped as illustrated in FIGS. 2 and 3, respectively, for reasons which will become clear hereinafter.

Still refering to FIG. 4, the end wall plate 18 is provided with a large opening 20 in communication with the interior of the cylinder 12, so as to permit large combustible items, such as hay bales, wood pieces, and auto tires, to name a few, to be loaded into the cylinder 12 for combustion. The opening 20 in the left end wall plate 18 is sealed by way of a door 22, typically molded from cast iron. Referring now to FIG. 2, the door 22 is attached to the end wall plate 18 by hinges 24*a* and 24*b* to overlie the opening 20 (FIG. 4). A latch 26 (FIG. 2) is provided to releasably secure the door 22 to the end wall plate 18 during heating unit operation.

Referring to FIG. 4, a perforated, fuel-supporting, burning platform 30 is disposed within the interior of cylinder 12 below the horizontal cylinder axis 31 (shown in phantom in FIG. 4) so as to run substantially the length of the cylinder 12. The burning platform 30 is typically manufactured from a 1" thick (2.54 cm) cast iron plate. When the burning platform 30 is secured within the cylinder, by guides (not shown) to maintain the position of the burning platform 30 within the interior of the cylinder 12 as illustrated in FIG. 3, the burning platform 30 effectively serves to subdivide the interior of the cylinder, as illustrated in FIG. 4, into a combustion cavity 32, which lies above the burning platform and an air passageway 34, which is bounded by the burning platform 30 and the bottom of cylinder 12.

Figure 5:
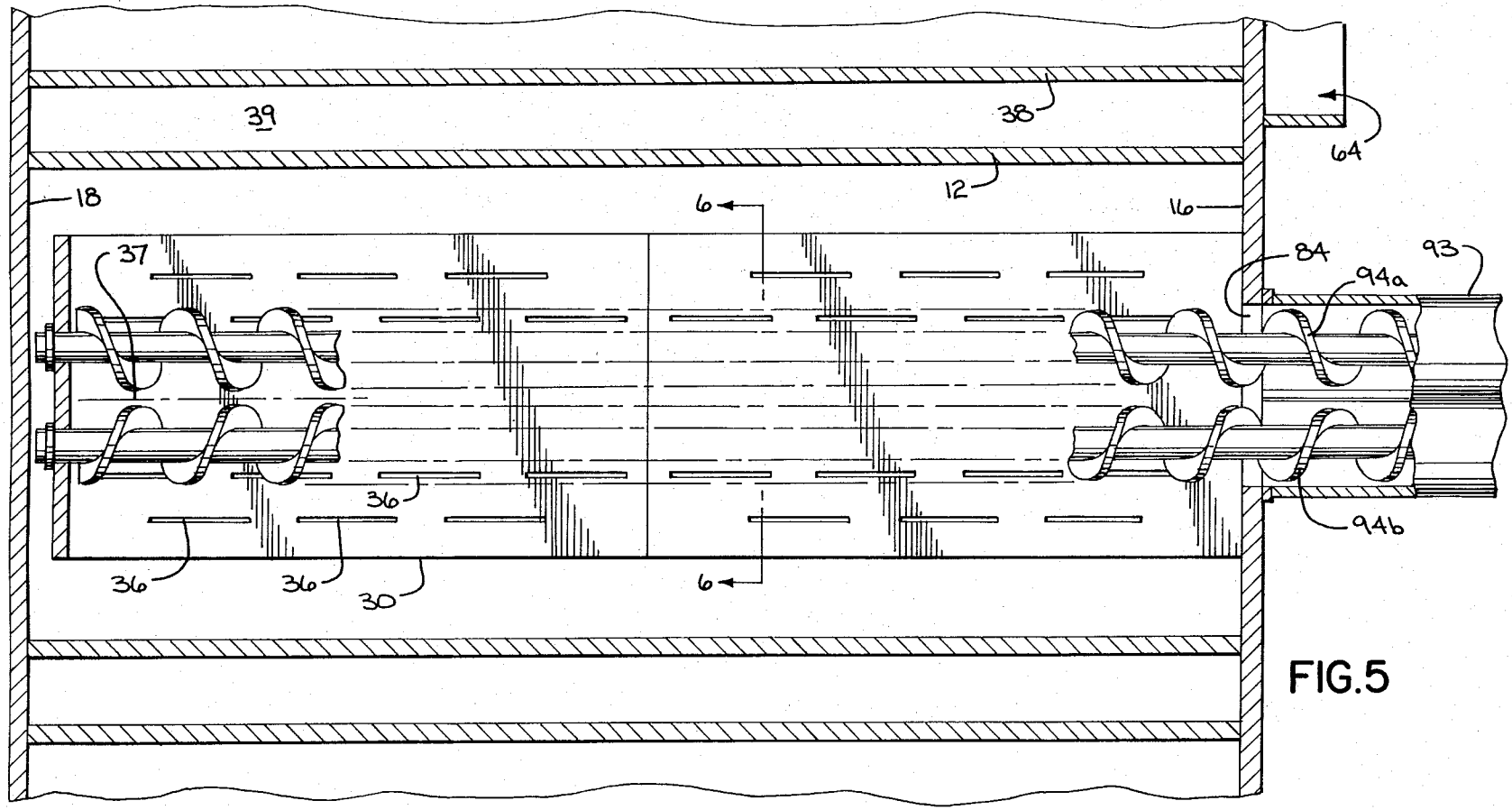
FIG. 5 is a cross-sectional view taken along lines 5—5 of FIG. 1.

Referring to FIG. 5, the burning platform 30 has a plurality of perforations 36. When outside air is forced into the air passageway 34 of FIG. 4, the air is forced upwardly through the perforations 36 to achieve primary combustion of the waste combustible material (not shown) supported by the burning platform 30. Returning to FIG. 5 in practice, the perforations 36 are arranged in two pairs of rows, the rows of each pair being on opposite sides of the burning platform centerline 37 (shown in phantom). The perforations 36 in each row are offset from the adjacent perforation in the other row of each pair. The rows of perforations 36 are each closer to a respective one of the edges of the burning platform than the centerline 37 so that the air rising through the perforations 36 enhances combustion at the edges of the burning platform 30. As a result, the flames of waste material combustion tend to sweep around the inner periphery of the cylinder 12.

As best illustarated in FIG. 2, the cylinder 12 is surrounded by a second cylinder 38 to create a void 39 between the cylinders. The void 39 is filled with heat exchange fluid 40, typically water, which serves as the heat exchange medium. As can now be appreciated, by locating the perforations 36 of FIG. 5 at the outer edges of the burning platform 30, heat transfer to the cylinder 12 and to fluid 40 is maximized.

Figure 6:
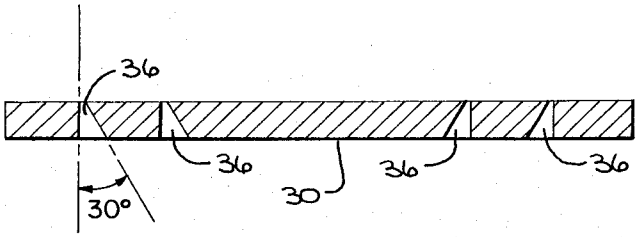
FIG. 6 is a cross-sectional view taken along line 6—6 of FIG. 5 illustrating the details of the perforations in the burning platform.

Referring to FIG. 6, each of the perforations 36 in the burning platform 30 appears as an inverted, truncated frustal conical aperture which tapers at approximately a 30 degree angle to an axis (shown in phantom) normal to the surface of the burning platform 30. By forming each performation 36 as an inverted truncated frustal conical aperture, the likelihood that any remaining ash on the burning platform will fall into the air passageway 34 is reduced.

Referring to FIG. 4, an air-carrying plenum 41 is disposed within the cylinder 12 a distance from the top of the cylinder to overlie a significant portion of, the burning platform 30. In practice, the air-carrying plenum 41 is formed of a baffle plate 42 and a baffle channel 44. When the baffle plate 42 is welded at each of its longitudinal side edges to the inside of the cylinder 12, the baffle plate 42 creates an air passageway 45 which is bounded between baffle plate 42 and the upper arc of the cylinder 12 subtended by the baffle plate. As illustrated in FIG. 4, the baffle plate 42 and baffle channel 44 do not run the entire length of the cylinder 12. Rather, the baffle plate 42 and the baffle channel 44 run from the rearward end of the cylinder 12 (the rightward end as illustrated in FIG. 4) to a point which is a short distance from the forward or leftward-most end of the cylinder 12, thereby creating an opening 46 leading from the combustion chamber cavity 32 into the air passageway 45. As will be described hereinafter, the air passageway 45 carries the exhaust gases from the combustion cavity 32.

Returning to FIG. 2, the baffle channel 44, is comprised of a "U" shaped structure having a planar section and a pair of upstanding flanges each running along one of the edges of the planar section. Each of the flanges of the baffle plate 44 is welded to the baffle plate 42 so that the baffle plate 42 and the baffle channel 44 form the plenum 41. The planar portion of the baffle channel 44 has a set of truncated frustal conical perforations 52 which are arranged in two pairs of rows in much the same fashion as the arrangement of the perforations 36 in the burning platform 30. In this way, the air forced between the baffle plate 42 and the baffle channel 44 is directed downwardly through the perforations 52 against the burning platform 30. As a result, the upwardly rising flames generated by combustion of the combustible waste material on the burning platform 30 of FIG. 4 are entrained, that is to say further oxygenated, by the pressurized air leaving the perforations 52 in the baffle channel 44.

In addition to oxygenating the flames of combustion, the pressurized air leaving the perforations 52 forces the flames against the burning platform 30. Any unburned combustion gases mixed in the flames are thus urged against the surface of the burning waste material supported by the burning platform 30. The hottest temperature within the combustion chamber cavity 32 is in fact adjacent the surface of the burning waste material supported by the burning platform 30. Thus, as the unburned combustion gases are forced downwardly against the surface of the burning waste material on the burning platform 30, the unburned fuel is ignited and nearly completely burned. In this way, unburned particulates, which are ordinarily lost to the atmosphere in a conventional heating unit, are burned by the heating unit of the present invention, thereby maximizing combustion efficiency.

Referring now to FIG. 4, the pressure of the air forced downwardly through the perforations 52 in the baffle channel 44 and the pressure of the air forced upwardly through the perforations 36 in the burning platform 30 forces the upwardly rising gaseous combustion byproducts into the opening 46 and through the passageway 45 to an exhaust outlet 54 disposed through the cylinder 38 and combustion chamber 12 in communication with the air passageway 45. The exhaust outlet 54 is relatively short, on the order of 12"–13" (30.5–33 cm) depending on the overall dimensions of the cylinder 12. Since the gaseous combustion byproducts are forced out from the combustion chamber cavity 32 under pressure as will become better understood hereinafter, a short exhaust outlet is very desirable in contrast to the typical vacuum type chimney associated with conventional natural draft heating devices. Moreover, the use of a short exhaust outlet avoids the buildup of creosote.

To maintain a very short path for the gaseous combustion byproducts existing the combustion chamber via the exhaust outlet 54, the heating unit 10 is usually operated outside of any closed structure. In this way, the gaseous combustion byproducts exit the exhaust outlet 54 directly into the environment. Since secondary oxygenation of the flames rising from the burning combustible waste material on the burning platform 30 enables practically all of the unburned particulates to be burned within the combustion chamber cavity 32, the exhaust gases exiting the combustion chamber via the exhaust outlet 54 are substantially free of particulates. In comparison to a conventional heating unit, the heating unit 10 of the present invention thus emits little if any smoke.

Referring jointly to FIGS. 1 and 3, heating unit 10 is provided with an air induction system 60 which forces air through the air passageway 34 and through the plenum 41 (both of FIG. 4) to facilitate efficient fuel combustion. Referring to FIG. 3 the air induction system 60 includes a blower 62 which forces air into a "U" shaped plenum 64. Air from the blower 62 enters the apex portion **64*a* of the plenum 64 and is carried by each of the interconnecting plenum legs 64*b* and 64*c* into the air passageway 34 and into the plenum 41, respectively. Referring now to both FIGS. 3 and 4, each of the legs 64*b* and 64*c* of the U-shaped air plenum 64 has a separate one of air dampers 66*a* and 66*b* disposed therein to regulate air flow into the air passageway 34 and plenum 41, respectively. Each of the dampers 66*a* and 66*b* is adjusted in accordance with the combustion characteristics of the waste material to be burned within the cylinder 12 to assure the most efficient combustion and hence, the greatest quantity of heat while reducing to a minimum the amount of particulates emanating from the exhaust outlet 54**.

Referring to FIG. 4, if the burning characteristics of the waste material burned within the combustion chamber are relatively uniform, then the dampers **66*a* and 66*b* can then be set manually so as to prevent both overoxygenation, which results in a loss of heat, and underoxygenation, which may cause objectionable smoke to be emitted from the heating unit 10 via the exhaust outlet 54. In instances where waste materials having different burning characteristics are to be burned at different times in the combustion chamber 12, manual adjustment of dampers 66*a* and 66*b* may become too cumbersome. To automatically regulate the air flow into air passageway 34 and plenum 41, a combustion efficiency analyzer 68, such as is commercially available from Honeywell Corporation, Minneapolis, Minnesota, is mounted with its sensor in the path of the exhaust gases leaving the exhaust outlet 54 to detect the efficiency of combustion by sensing the density of the combustion byproducts exiting the combustion chamber via exhaust outlet 54. The output of the combustion efficiency analyzer 68 is applied to a motor control circuit 70, such as are well known in the art. In accordance with the output signal produced by the combustion efficiency analyzer 68, the motor control circuit 70 energizes each of motors 72*a* and 72*b*. Each of motors 72*a* and 72*b* are coupled to a corresponding one of dampers 66*a* and 66*b*, respectively, to automatically regulate the actuation of the corresponding damper to control the amount of primary air flow through air passageway 34 and the amount of secondary air flow through plenum 41** to assure maximum combustion efficiency.

Still referring to FIG. 4, in addition to controlling each of the motors **72*a* and 72*b* associated with dampers 66*a* and 66*b*, respectively, the motor control unit 70 also controls a motor 75 (FIG. 3), which drives a damper 78 operatively disposed in the exhaust outlet 54. By appropriately actuating motors 72*a* and 72*b* and motor 75, the control 70 can cause the dampers 66*a*, 66*b* and 78 to be fully closed. Closing the dampers 66*a*, 66*b* and 78 serves to starve the combustion chamber cavity 32** of a substantial amount of oxygen to cause the fuel to smolder, thereby allowing for re-ignition upon damper opening.

Referring to FIG. 4, the right end wall plate 16 is provided with a first opening 80 therethrough located between the legs **64*b* and 64*c* of the air induction chamber 64. During the combustion of the waste combustible material within the cylinder 12, both end wall plates 16 and 18 tend to expand from the resulting heat. Just as the opening 24 in the end wall plate 18 allows plate 18 to expand, the opening 80 advantageously allows the end wall 16 to expand without buckling. A heat shield 82 overlies the opening 80. As illustrated in FIG. 3, the heat shield 82 may be hingedly mounted so as to allow ready access through opening 80 into the combustion cavity 32 of the chamber 12**.

Still referring to FIG. 4, in addition to the opening 80 through the end wall 16, a second opening 84 is provided therethrough so as to lie below opening 80 but above the leg 64c of the air induction chamber 64. The opening 84 is provided to allow pellet-sized combustible material such as sawdust, wood chips or even corncobs, to name a few, to be automatically fed into the combustion chamber.

Turning now to FIG. 1, to achieve automatic feeding of pellet-sized combustible material, the heating unit 10 advantageously includes a fuel feeder 86 comprised of a storage bin 87 for storing a quantity of pellet size combustible material. An agitator 88 and an auger 89 are each rotably journaled into the storage bin 87 and are jointly driven by a motor 90. The auger 89 extends outwardly from the storage bin 87 into an outlet pipe 91 which connected by way of an elbow 92 to a fuel feed hopper 93 mounted to the end wall plate 18 of the heating unit 10 in communication with opening 84 (illustrated only in FIG. 4). The elbow 92 serves to carry the pellet size fuel from the outlet pipe 91 into the fuel feed hopper 93 upon rotation of the auger 89.

The pellet-sized fuel is carried by the elbow 92 and is deposited into the fuel hopper 93 above the level of fuel in the storage bin 87. The elbow 92 tapers outwardly as it rises upwardly to prevent binding of fuel in the elbow. As the fuel rises in the elbow 92, a portion of the fuel drops back into the elbow, causing fuel to accumulate which blocks the release of pressurized air from the cylinder 12. A pair of oppositely pitched augers **94*a* and 94*b* (illustrated in FIG. 5) are journaled in the hopper 93 and extend from the fuel feed hopper 93 through the opening 84 (FIG. 4) and into the combustion chamber cavity 32. Referring back to FIG. 1, the augers 94*a* and 94*b* (FIG. 5) are driven in opposite directions by an electric motor 95 to evenly feed fuel from the fuel feed hopper 93 into the combustion chamber cavity 32 and throw the fuel onto the burning platform 30 adjacent to the burning platform perforations 36. The use of a pair of oppositely-pitched, counter-rotating augers 94*a* and 94*b* avoids the disadvantage of uneven fuel feeding onto one side of the burning platform 30 which would occur if a single auger were substituted in place of the oppositely-pitched, counter-rotating augers 94*a* and 94*b*. Turning now to FIG. 4, a feed-protective shield 96 overlies the augers 94*a* and 94*b* to protect the augers against overheating during fuel combustion and to prevent solid fuel manually fed into cylinder 12** from damaging the augers.

Referring now to FIGS. 2 and 4, the cylinder 38 is not concentric about cylinder 12. Rather, the axis of the cylinder 38 is offset from the axis of the cylinder 12 so that a larger space is created above cylinder 12 than below the cylinder 12. By offsetting the cylinder axes, more of the heat exchange fluid 40 lies above the level of the burning waste material supported by the burning platform 30 than below it. Consequently, the heat exchange fluid 40 is exposed to the most intense heat of fuel combustion within the cylinder 12 to assure efficient heat transfer.

As best illustrated in FIG. 4, a fluid inlet 102 is disposed through cylinder 38 in communication with the void 39 near the forward end of the cylinder 38. Now referring to FIG. 3, a fluid outlet 104 is disposed through the end wall plate 16, in communication with the void 39 above the top of the cylinder 12. The fluid inlet 102 and the fluid outlet 104 allow the heat exchange fluid 40 of FIGS. 2 and 4 to circulate through the entire length of void 39 and between heating unit 10 and an external loop containing one or more heating coils (not shown) as a consequence of the thermosiphon effect, to enable recovery of the heat of combustion. Referring to FIG. 3, a drain outlet 105 is disposed through the end wall plate 18 into the void 39 below the level of cylinder 12. The drain outlet 105 allows the heat exchange fluid 40 to be drained from the heating unit.

The heating unit 10 may be advantageously utilized to dry crops or the like stored within a silo or similar structure. By first heating air from the heat exchange fluid 40 and by circulating the heated air within the silo, the crop moisture content can be removed. Utilizing the heating unit 10 of the present invention in this manner to dry crops has several advantages over conventional crop drying heating devices. Firstly, the heating unit 10 of the present invention readily burns combustible biomass products which are usually in abundant supply on a farm, thereby reducing the fuel costs. In addition, most present day crop drying heating devices accomplish crop drying by forcing the heated exhaust gases of fossil fuel combustion through the crops to reduce the crop moisture content. As will be recognized by those skilled in the art, the heated exhaust gases of fossil fuel combustion contain, as a combustion byproduct, water, so that as the crops are heated by the exhaust gases of conventional fossil fuel fired crop dryers, water is in fact added to the crops as the moisture content is being reduced by heating. Thus, in comparison with conventional fossil fuel fired crop drying heating units, the heating unit 10 of the present invention is believed to achieve greater efficiency.

Still referring to FIG. 3, a pair of ports 106 and 108 are also each disposed through the end wall plate 16, in communication with the void 39 above cylinder 12. Port 106 is sealed by way of a pressure release valve (not shown) which is set to open at a predetermined pressure, thereby preventing the build-up of fluid pressure within the void 39. Port 108 is dimensioned to receive an aquastat 112 illustrated in FIG. 4. Referring to FIG. 4, the aquastat 112 changes conduction states when the temperature of the heat exchange fluid 40 exposed to the aquastat differs from a preset temperature. The electrical switch contacts of the aquastat 112 are coupled to the motor 95 which drives augers **94*a* and 94*b* of FIG. 1, so that as heat demand increases (as sensed by a drop in the temperature of the heat exchange fluid 40 in void 39), the aquastat 112 signals the motor 95 to feed fuel into the cylinder 12. The addition of fuel into the cylinder 12 ultimately results in the radiation of additional heat, which in turn raises the temperature of the heat exchange fluid 40. Once the temperature of the heat exchange fluid reaches the preset temperature, then the aquastat 112 turns off motor 95 of FIG. 1. An automatic switch (not shown) controls motor 90 in response to the level of fuel in the fuel feed hopper 93. Should the level of fuel in the fuel feed hopper drop, then motor 90 is energized to feed additional fuel into the fuel feed hopper 93. For as long as sufficient fuel is available in the storage bin 87 of FIG. 1, control of the heating device is automatically maintained by the aquastat 112**.

Since the heating unit 10 is directly exposed to the environment, the heating unit 10 may be exposed to very low temperatures depending on the climate. Referring to FIG. 2, to reduce the amount of heat radiated by the cylinder 38 to the environment during heating unit operation, the cylinder 38 is surrounded by an insulation blanket 115 which is formed by a plurality of strips of commercially available fiberglass insulation. To protect the insulation blanket 115 from the elements, a pair of sheet metal panels 120*a* and 120*b* are each secured at their edges to a separate one of the top sloping edges of each of end wall plates 16 and 18, respectively, so that the adjacent longitudinal edges of the sheet panels 120*a* and 120*b* abut one another to form a pitched roof to deflect rain or snow. A pair of sheet metal panels 120*c* and 120*d* are each joined at each of their ends to a separate one of the side edges of end wall plates 16 and 18 to abut the longitudinal edge a separate one of panels 120*a* and 120*b*.

The foregoing describes an improved heating unit for achieving nearly complete combustion of waste combustible materials and efficient heat recovery therefrom.

While only certain preferred features of the invention have been shown by way of illustration, many modifition and changes will occur to those skilled in the art. For example, although the heating unit 10 has been described as including a fuel feeder 86, it may be appreciated that the fuel feeder 86 is not required for heating unit operation. It is, therefore, to be understood that the appended claims are intended to cover all such modifications and changes as fall within the true spirit of the invention.

What is claimed is:

1. A heating unit which comprises:

A combustion chamber having an opening therein for admitting fuel into said combustion chamber;

a perforated burning platform disposed within said combustion chamber and spaced apart from the bottom of the combustion chamber for supporting fuel thereon;

first air forcing means carried in part by said combustion chamber for forcing air into the space beneath the burning platform where it flows upwardly through said perforated burning platform to achieve combustion of the fuel supported thereby;

second air forcing means including a perforated plenum which is positioned above the burning platform and spaced apart from the top of the combustion chamber, said second air forcing means being operable to direct air through said perforated plenum and downward against the fuel supported by said burning platform;

an exhaust outlet formed in the top of said combustion chamber and communicating with the space above said perforated plenum for dispelling the gaseous combustion byproducts forced therethrough from the combustion chamber by the pressure of air forced by said first and second air forcing means; and a heat exchanger surrounding said combustion chamber for recovering heat.

2. The invention according to claim 1 wherein said first air forcing means comprises:

an air passageway lying between said perforated burning platform and said combustion chamber;

blower means; and an air inlet connecting said air passageway and said blower means for carrying the air forced by said blower means into said air passageway and upwardly through said perforated burning platform.

3. The invention according to claim 2 further including damper means disposed in said air inlet for regulating the flow of air forced into said air passageway by said blower means.

4. The invention according to claim 1 wherein said perforated plenum comprises;

a baffle plate disposed within said combustion chamber so as to overlie a substantial portion of said burning platform;

a perforated, baffle channel affixed to said baffle plate so as to create an air passageway therebetween, the perforations in said baffle channel being directed downward towards said burning platform;

an air inlet formed through a combustion chamber wall and coupled to the air passageway formed between said baffle plate and said perforated baffle channel; and blower means for forcing air through said air inlet into said air passageway between said baffle plate and said baffle channel.

5. The invention according to claim 4 further including damper means disposed in said air inlet for regulating the air flow into said air passageway between said baffle plate and said baffle channel.

6. The invention according to claim 1 further including combustion efficiency analyzing means responsive to the gaseous combustion by products forced through said exhaust outlet for controlling the amount of air forced by said first and second air forcing means in accordance with the efficiency of combustion determined from said gaseous combustion by products to achieve maximum combustion efficiency.

7. An improved heating device comprising:

a combustion chamber;

a perforated, burning platform secured within said combustion chamber a distance up from the combustion chamber bottom to create a first air passageway which lies between said burning platform and the bottom of said combustion chamber;

an air-carrying plenum means disposed within said combustion chamber a distance from the top of the combustion chamber to create a second air passageway which lies between said plenum means and the top of said combustion chamber, said air-carrying plenum means having perforations therein opposing said perforations in said burning platform;

an air system for admitting air into said first air passageway and directing it upwardly through said burning platform to enhance combustion of material supported by said burning platform and for admitting air through said plenum means and directing it downward against said burning platform;

an exhaust outlet disposed through the top of said combustion chamber in communication with said second air passageway between said plenum means and the top of the combustion chamber for providing an escape path for combustion bases which are forced into said second air passageway by the pressure of air expelled through said plenum means and said burning platform; and a heat exchanger surrounding said combustion chamber.

8. The invention according to claim 7 wherein said combustion chamber comprises:

a heat conductive cylinder;

a first end wall plate sealing one of the open ends of the cylinder;

a second end wall plate sealing the other of the open ends of the cylinder, said second end wall plate having a passage therethrough for admitting combustible material into the combustion chamber; and a door hingedly connected to said second end wall plate to overlie the passage therein.

9. The invention according to claim 8 wherein each of said first and second end walls extend below the base line of said cylinder so that said cylinder is supported above ground level by said end wall plates.

10. The invention according to claim 7 wherein said plenum means comprises:

a baffle plate parallel to and spaced apart from said burning platform so as to overlie a portion thereof; and a perforated, U-shaped channel secured in each of the upper edges to said baffle plate so as to create an air passageway therebetween.

11. The invention according to claim 7 wherein said air system comprises:

a blower;

a first air inlet in communication with said plenum means and said blower for carrying the air forced by said blower into said plenum means;

a first air damper disposed in said first air inlet to regulate the flow of air through said first air inlet into said plenum means;

a second air inlet in communication with said blower means and said first air passageway for carrying the air forced by said blower means into said first air passageway; and a second air damper disposed in said second air inlet for regulating the amount of air forced by said blower means into said first air passageway.

12. The invention according to claim 11 further including:

a combustion efficiency analyzer disposed adjacent to said exhaust outlet for detecting the efficiency of combustion of the waste material within said combustion chamber;

first driving means in operative engagement with said first air damper and responsive to said combustion efficiency analyzer for driving said air damper to control the air flow through said first air inlet in accordance with the efficiency of combustion detected by said combustion efficiency analyzer; and second driving means in operative engagement with said second damper and responsive to said combustion efficiency analyzer for driving said second damper to control air flow through said second air inlet in accordance with the efficiency of combustion detected by said combustion efficiency analyzer.

13. The invention according to claim 7 wherein said heat exchanger comprises:

a jacket surrounding said combustion chamber to create a void therebetween through which a heat exchange fluid can circulate;

a fluid inlet in communication with said void for admitting the heat exchange fluid into said void; and a fluid outlet in communication with said void for carrying the heat exchange fluid from said void.

14. The invention according to claim 13 wherein said jacket is positioned non-concentrically about said combustion chamber so that a greater portion of the heat exchange fluid lying in the void between said jacket and said combustion chamber lies above said burning platform so that heat transfer between said combustion chamber and said heat exchange fluid is maximized.

15. The invention according to claim 14 further including an insulation blanket surrounding said water jacket to retard the heat radiated thereby; and a protective skin surrounding said insulation blanket to protect said insulation blanket from exposure.

16. The invention according to claim 1 further including fuel feeding means for automatically feeding combustible waste material into said combustion chamber so as to be burned therein.

17. The invention according to claim 16 further including control means for controlling said feeding means to regulate the amount of combustible waste material fed into said combustion chamber by said feeding means in response to the temperature of said heat exchanger.

18. The invention according to claim 16 wherein said fuel feeding means comprises:

a fuel storage bin;

a fuel feed hopper in communication with said combustion chamber;

a connecting conduit connecting said fuel storage bin to said fuel feed hopper;

a first fuel feeder for feeding fuel from said storage bin into said fuel feed hopper via said connecting conduit; and second fuel feeder means including a pair of opposing pitch, counter-rotating augers lying below said communication conduit for feeding fuel from said fuel feed hopper into said combustion chamber.

* * * * *